US011946645B2

(12) United States Patent
Morson et al.

(10) Patent No.: US 11,946,645 B2
(45) Date of Patent: Apr. 2, 2024

(54) COMBUSTOR CASING COMPONENT FOR A GAS TURBINE ENGINE

(71) Applicant: ROLLS-ROYCE plc, London (GB)

(72) Inventors: Lloyd D. Morson, Bristol (GB); Julien Digoude, Bristol (GB)

(73) Assignee: Rolls-Royce plc (GB)

( * ) Notice: Subject to any disclaimer, the term of this patent is extended or adjusted under 35 U.S.C. 154(b) by 0 days.

(21) Appl. No.: 18/349,275

(22) Filed: Jul. 10, 2023

(65) Prior Publication Data

US 2024/0011636 A1 Jan. 11, 2024

(30) Foreign Application Priority Data

Jul. 11, 2022 (GB) ..... 2210143

(51) Int. Cl.

| | |
|---|---|
| ***F23R 3/60*** | (2006.01) |
| ***F01D 9/04*** | (2006.01) |
| ***F01D 25/24*** | (2006.01) |
| ***F23R 3/00*** | (2006.01) |

(52) U.S. Cl.

CPC ..... *F23R 3/60* (2013.01); *F01D 9/044* (2013.01); *F01D 25/24* (2013.01); *F23R 3/002* (2013.01)

(58) Field of Classification Search

CPC ..... F01D 9/044; F01D 25/24; F23R 3/002; F23R 3/42; F23R 3/44; F23R 3/46; F23R 3/50; F23R 3/52; F23R 3/54; F23R 3/60

See application file for complete search history.

(56) References Cited

U.S. PATENT DOCUMENTS

| | | | | |
|---|---|---|---|---|
| 4,870,826 | A * | 10/1989 | Daguet | F04D 29/542 60/751 |
| 5,115,642 | A * | 5/1992 | Cvelbar | F01D 9/044 60/751 |
| 5,592,821 | A * | 1/1997 | Alary | F04D 29/544 60/751 |
| 2002/0184893 | A1 | 12/2002 | Farmer et al. | |
| 2007/0044935 | A1 | 3/2007 | Memmen | |
| 2013/0259664 | A1* | 10/2013 | Denis | F01D 25/243 228/160 |
| 2018/0128321 | A1* | 5/2018 | Struck | F01D 11/003 |
| 2022/0136443 | A1 | 5/2022 | Ryon et al. | |

FOREIGN PATENT DOCUMENTS

| | | | |
|---|---|---|---|
| EP | 1759788 | A2 | 3/2007 |
| EP | 2078826 | A2 | 7/2009 |
| JP | 2006242559 | A | 9/2006 |
| WO | 2014200588 | A2 | 12/2014 |

OTHER PUBLICATIONS

Great Britain search report dated Dec. 15, 2022, issued in GB Patent Application No. 2210143.0.

* cited by examiner

*Primary Examiner* — Scott J Walthour

(74) *Attorney, Agent, or Firm* — Barnes & Thornburg LLP

(57) ABSTRACT

A combustor casing component for a gas turbine engine which is manufactured as a single-piece. The combustor casing component has a combustor outer casing portion, an outlet guide vane outer case portion, a pre-diffuser portion, a plurality of outlet guide vanes, and an outlet guide vane inner case portion.

16 Claims, 8 Drawing Sheets

COMBUSTOR CASING COMPONENT FOR A GAS TURBINE ENGINE

CROSS-REFERENCE TO RELATED APPLICATIONS

This specification is based upon and claims the benefit of priority from United Kingdom patent application number GB 2210143.0 filed on Jul. 11, 2022, the entire contents of which is incorporated herein by reference.

BACKGROUND

Technical Field

The present disclosure relates to a casing for the combustion sub-system of a gas turbine engine.

Description of the Related Art

Gas turbine engines are complex pieces of machinery used in a number of industries for various uses. In the field of aviation, gas turbine engines generally need to have a long lifetime and meet extremely stringent safety requirements whilst operating under extreme conditions. This inevitably means they are also very expensive to make.

However, not all aviation gas turbine engines are used for the same applications. There are some applications that require smaller, cheaper gas turbine engines, or that do not have a need for a long service life, such as drones. For engines used in applications such as these, other factors become more important, such as reduced size, speed of manufacture, and low cost.

Gas turbine engines are also used in the field of energy production, for example at power plants. In these environments, different criteria are important to those valued in the aviation industry. For example, the material weight is less important for an engine which will perform its operation entirely on the ground, but production cost is more of a factor for the industry.

As such, there is a need to find new ways of manufacturing gas turbine engine components, of reducing their cost, and increasing the speed with which they can be produced.

SUMMARY

The present disclosure concerns a single-piece combustor casing component for a gas turbine engine, and a gas turbine engine.

According to a first aspect there is provided a single-piece combustor casing component for a gas turbine engine, the single-piece component comprising a combustor outer casing portion, an outlet guide vane outer case portion, a pre-diffuser portion, a plurality of outlet guide vanes, and an outlet guide vane inner case portion.

Such a combustor casing component can be made quickly, cheaply, and takes less time to construct and install than the equivalent multi-piece construction for performing the same functions within a gas turbine engine.

The single-piece combustor casing component may further comprise an end surface having a plurality of blind holes for receiving connectors. By positioning the blind holes on the end surface of the combustor outer casing portion, further pieces can be attached to the component without the need for aerodynamically-challenging flanges.

The combustor outer casing portion can comprise one or more axial ribs, and at least one of the plurality of blind holes is radially aligned with an axial rib. One or more axial ribs can be on the external and/or internal surface of the combustor outer casing portion. The combustor outer casing portion can have one or more axial ribs on both the internal and external surfaces, and each axial rib on the external surface is radially aligned with an axial rib on the internal surface. These design options make for an efficient way of strengthening the combustor outer casing portion and maximising the material around the blind holes whilst minimising the impact on the aerodynamics of the component.

The single-piece combustor casing component can have a mounting flange for a retractable fuel stem. The mounting flange can be configured to receive two attachment elements. Incorporating a mounting flange into the component reduces the part count, construction and installation time. Requiring only two attachment elements also reduces the part count, construction and installation time.

Extending radially from the outlet guide vane to the combustor outer casing portion, the configuration of the component may be as follows: the pre-diffuser portion may be attached to an extended downstream from the furthest radial extent of the outlet guide vane, the outlet guide vane outer case portion may be attached to an extended upstream from the greatest radial extent of the pre-diffuser portion, and the combustor outer casing portion may be attached to an extended upstream from the furthest radial extent of the outlet guide vane outer case portion.

Such a configuration creates a spring-like section which allows for a degree of flexion within the component, which can be useful where thermal gradients can lead to material expansion, as the flexion reduces the chances of stress fractures occurring.

The pre-diffuser portion of the single-piece combustor casing component can have one or more apertures to allow gas to pass through the pre-diffuser portion from within the component to outside of the component. The presence of such apertures can significantly reduce or eliminate the boundary layer downstream of the outlet guide vane.

Where the outlet guide vanes meet the outlet guide vane outer case portion, and the outlet guide vane outer case portion is formed of a material that can be scalloped so as to reduce the difference in material thickness between the outlet guide vanes and the outlet guide vane outer case portion. Where the outlet guide vanes meet the outlet guide vane inner case portion, and the outlet guide vane inner case portion is formed of a material that can be scalloped so as to reduce the difference in material thickness between the outlet guide vanes and the outlet guide vane inner case portion. Such scalloping helps reduce thermal stress in the component, by adapting regions where otherwise a thick portion of material would be in contact with a much thinner piece of material, which could lead to a point of thermal stress.

The outlet guide vane outer case portion can have one or more ridges for increasing the stiffness of the outlet guide vane outer case portion. The outlet guide vane inner case portion can also have one or more ridges for increasing the stiffness of the outlet guide vane inner case portion.

The outlet guide vane inner case portion can have a sliding joint for interfacing with a combustor inner casing. Such a sliding joint interface reduces the mechanical load that would otherwise be transferred from the combustor inner casing portion, through the outlet guide vane inner case portion, to the comparatively fragile compressor outlet guide vanes.

The outlet guide vane inner case portion can have a hoop-stiffening feature proximal to the sliding joint to reduce galling and fretting.

According to a second aspect there is provided a gas turbine engine comprising the single-piece combustor casing component of the first aspect. Such a gas turbine engine is cheaper and quicker to manufacture.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying figures. Further aspects and embodiments will be apparent to those skilled in the art.

Figure 1:
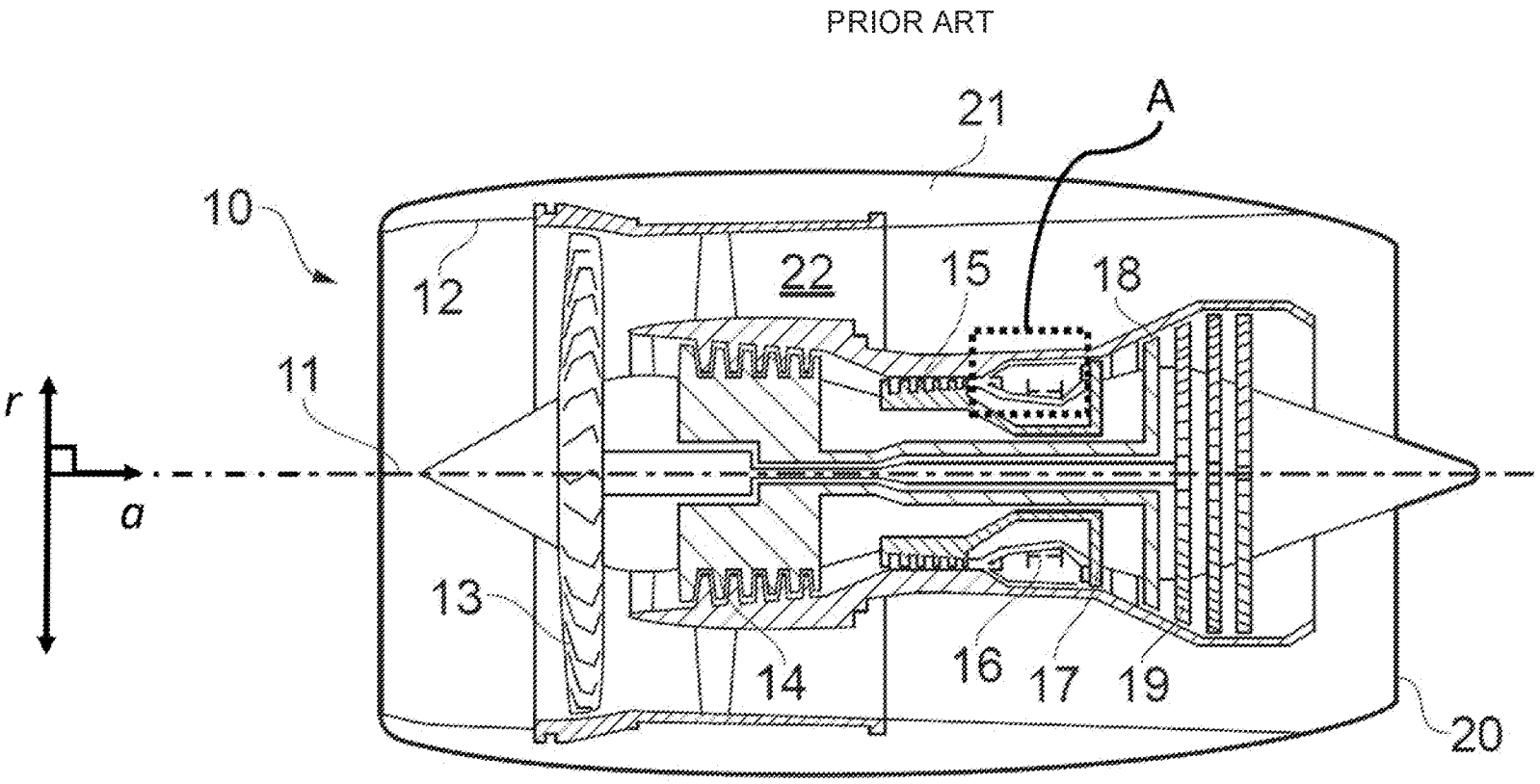
FIG. 1 is a sectional side view of a known gas turbine engine.

With reference to FIG. 1, a sectional view of a known gas turbine engine 10 is shown, having a principal and rotational axis 11. The engine 10 comprises, in axial flow series, an air intake 12, a fan 13 for propulsion, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

References in this disclosure to "upstream" and "downstream" refer to the direction of gas flow through the engine when in use, as will be understood by the person skilled in the art. Therefore references in this disclosure to "upstream" indicates elements of the engine which are closer to the intake 12 of the engine, or a direction which takes an element closer to the intake 12 of the engine, the intake being an element of the engine proximal to the engine's most upstream part. Similarly, references in this disclosure to "downstream" refer to elements of the engine which are closer to the exhaust nozzle 20, or a direction which takes them closer to the exhaust nozzle 20, the exhaust nozzle 20 being an element of the engine proximal to the engine's most downstream part.

For the avoidance of doubt, references to "radial" or "radially" used herein refer to vectors extending outwardly from, and perpendicular to, the principal and rotational axis 11, as indicated by the vector r shown in FIG. 1. Similarly, references to "axial" or "axially" used herein refer to vectors extending along, and parallel to, the principal and rotational axis 11, as indicated by the vector a shown in FIG. 1.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
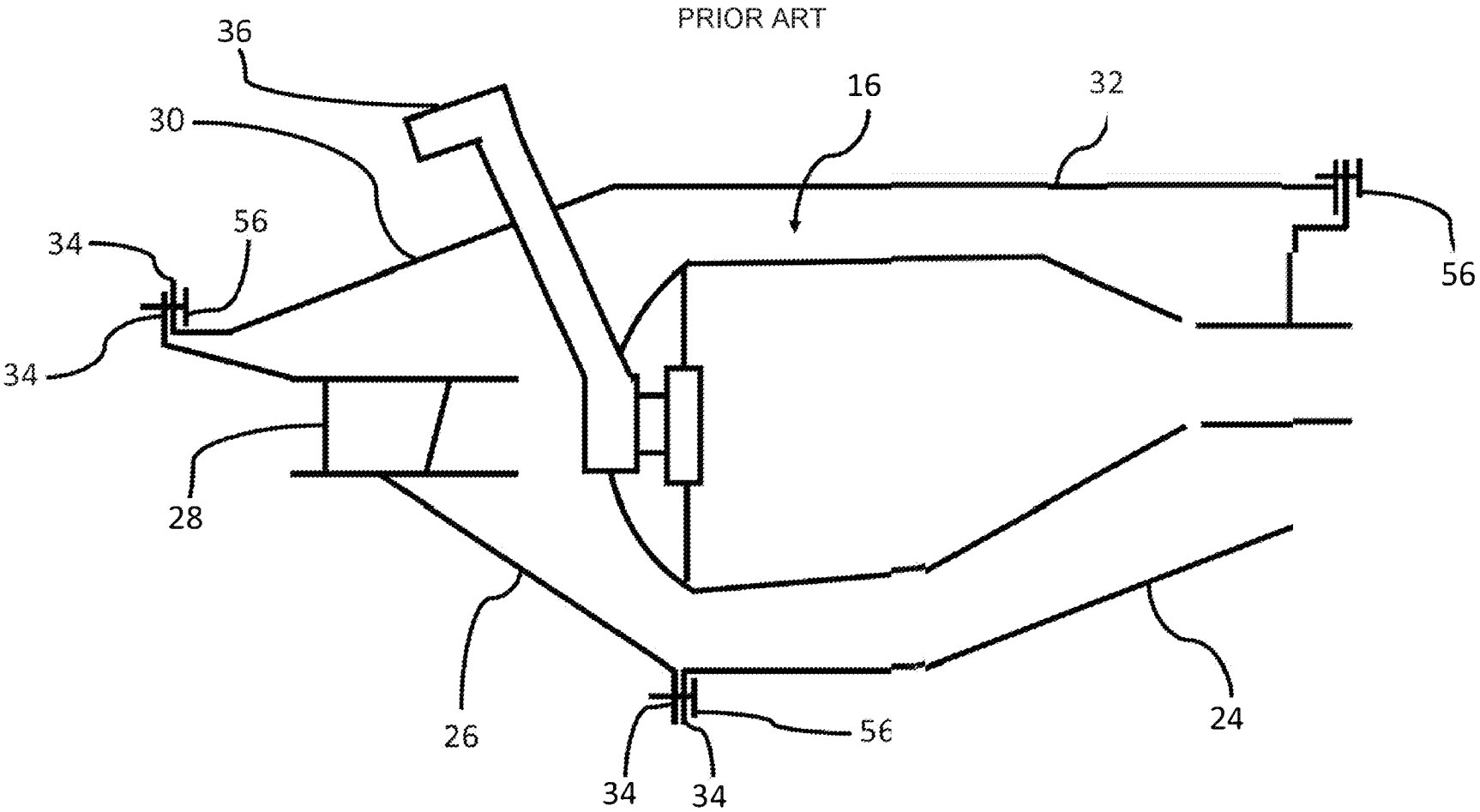
FIG. 2 is a sectional view of the boxed-out region labelled A in FIG. 1, showing the region around the combustion equipment of the known gas turbine engine of FIG. 1.

FIG. 2 shows a close up of the boxed-out region labelled A in FIG. 1, i.e. the region around the combustion equipment 16 from the known engine of FIG. 1. It is to be understood FIG. 2 shows a sectional view from the half of the gas turbine engine shown above the principal and rotational axis 11 in FIG. 1, and that the same arrangement is replicated in the half of the gas turbine engine shown below the principal and rotational axis 11, and indeed also out of plane of the figures, such that the combustion equipment in fact forms a ring-like structure around the principal and rotational axis 11 of the gas turbine engine 10. Whilst only a single outlet guide vane 28 is shown, it will be understood that multiple outlet guide vanes are present in the engine, forming a ring of vanes around the principal and rotational axis 11. It is therefore also to be understood that the single-piece combustor casing component shares the same principal and rotational axis 11 as the gas turbine engine 10. It is conventional to show a half-section of a gas turbine engine for clarity, where there is rotational symmetry of features around the principal and rotational axis 11 of the engine. The same principle is also applied here to the single-piece combustor casing component 40 (see FIG. 3).

FIG. 2 represents the known arrangement for the region of the gas turbine engine around the combustion equipment 16, downstream of the high-pressure compressor 15 (see FIG. 1). Shown in FIG. 2 are the combustor inner casing 24, which is connected to the outlet guide vane inner case 26, which is connected to the high-pressure compressor outlet guide vane 28 (hereafter "outlet guide vane" is used to refer to the high-pressure compressor outlet guide vane), which is connected to the outlet guide vane outer case 30, which is connected to the combustor outer casing 32. Flanges 34 are shown which allow for the connection of the different parts using standard connectors 56 such as rivets or nuts and bolts. The combustion equipment 16 is radially situated within the cases 26, 30 and casings 24, 32, and is supplied with fuel via a fuel stem 36 which passes through an aperture in the combustor outer casing 32.

Figure 3:
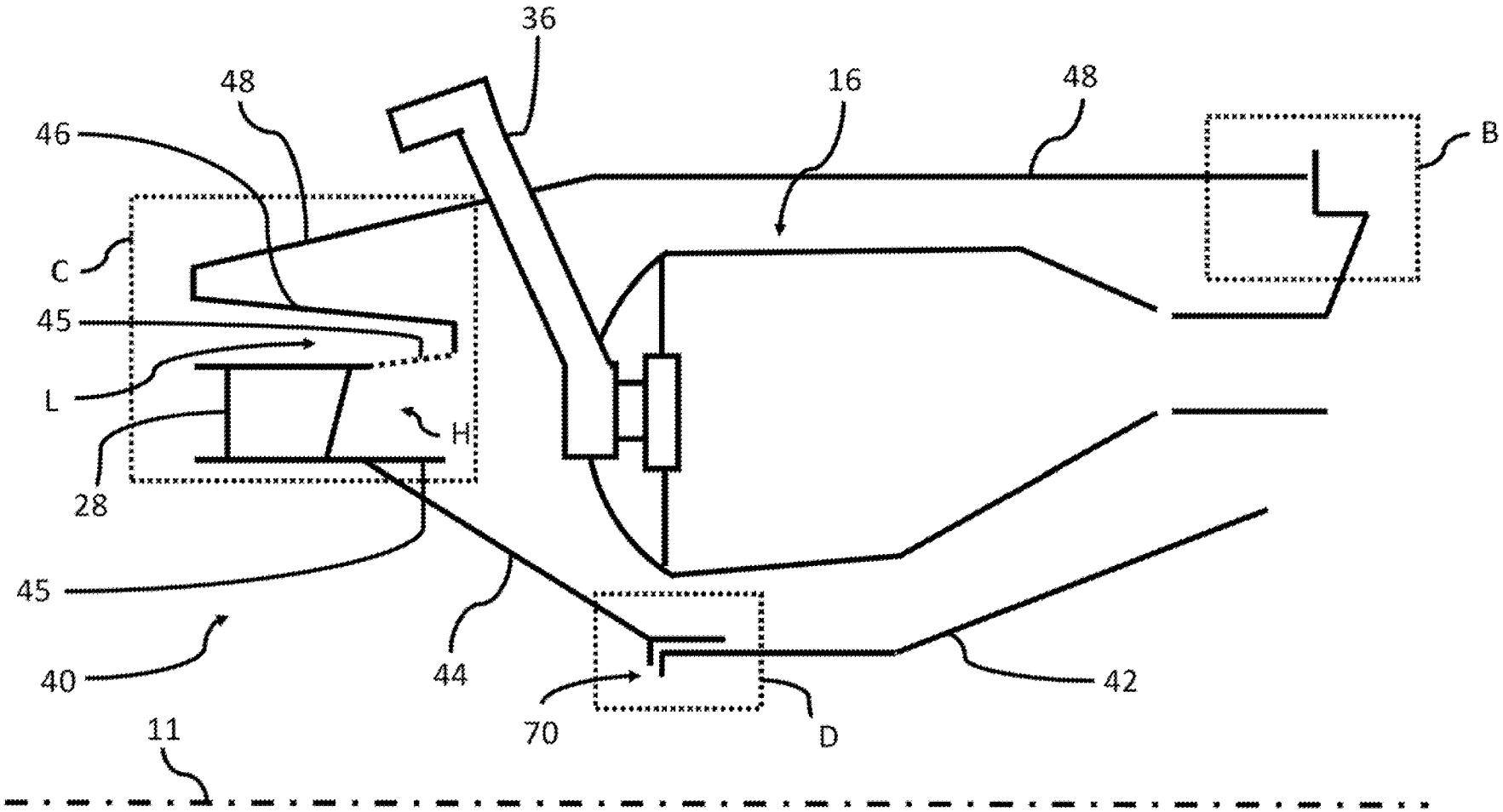
FIG. 3 is a sectional view of the equivalent boxed-out region labelled A in FIG. 1, but for a gas turbine engine that has a single-piece combustor casing component according to the present disclosure.

FIG. 3 shows the equivalent region (boxed-out region A from FIG. 1) within a gas turbine engine 10 fitted with a single-piece combustor casing component 40 of the present disclosure. The component 40 includes an outlet guide vane inner case portion 44, a plurality of outlet guide vanes 28 (only one shown in FIG. 3 due to the component being shown in section view), a pre-diffuser portion 45, an outlet guide vane outer case portion 46, and a combustor outer casing portion 48. In this exemplary embodiment the component is made using known additive layer manufacturing (ALM) techniques and/or investment casting. In this exemplary embodiment the component is made of INCONEL® 718 nickel-chromium superalloy, but it could also be made of HAYNES® 282 Ni—Cr—Co—Mo—Al—Ti superalloy, or other nickel and cobalt-chromium based powders suitable both for the operating conditions and for ALM techniques. When made using ALM techniques, the pre-diffuser portion 45 can have a number of holes running through it, as indicated by the use of a dashed line (see also FIGS. 9 and 10). When using investment casting, it is not currently possible to form such apertures in the pre-diffuser. In this case, the pre-diffuser portion has the same orientation, shape, and position, but comprises a solid boundary instead of a perforated boundary.

The inventors have found that it is possible to make a single component combining what have previously been separate components into a single piece, and in doing so have reduced the cost, manufacturing time and assembly time of gas turbine engines including the component compared to prior art gas turbine engines.

FIGS. 4, 5, 6, and 7 show alternative embodiments of the boxed-out region labelled B in FIG. 3, where the combustor outer casing portion 48 connects to a turbine nozzle guide vane support structure 50. Prior art designs have required the inclusion of a radially extending flange (schematically illustrated in FIG. 2) in order to provide surfaces suitable for connection, for example using a nut and bolt, rivet, or other suitable connector 56. However, the inventors have adapted the design of the component to include blind holes 52 (with only one being visible in this partial sectional view) in a downstream end surface 54 of the combustor outer casing portion 48. The blind hole is shown in these embodiments as having a longitudinal axis aligned parallel to the body of the combustor outer casing portion, such that, when fitted, the longest axis of the connector is aligned to run along and within the bounds of the combustor outer casing portion. By including blind holes in the downstream end surface, i.e. the most downstream surface of the combustor outer casing portion which is radially within the bounds of the radially inner and radially outer surfaces of the combustor outer casing portion, a radially protruding flange is no longer necessary for connecting the combustor outer casing portion 48 to the turbine nozzle guide vane support structure 50. Instead, a less intrusive thickened region at the downstream end of the combustor outer casing portion can house the end of a suitable connector 56, such as a nut, or rivet. By replacing the radially protruding flange with the thickened end region, the joint becomes more streamlined, and the aerodynamics of gas flow (indicated by the block arrow in FIGS. 4, 5, 6, and 7) in the region is improved, improving the efficiency of the engine.

In the example shown, the body of the combustor outer casing portion 48 is aligned so as to be generally parallel with the central axis of the component, meaning the axis of the blind hole is also oriented so as to have its longitudinal axis run parallel to a central axis of the component, which is also the rotational axis of the combustor outer casing portion, and the principal and rotational axis 11 of the component 40 and the gas turbine engine 10. It will be understood though that the combustor outer casing portion 48 does not have to run precisely parallel to the principal and rotational axis 11 of the component 40 or the gas turbine engine 10. Given the desire for efficient aerodynamic gas flow within the engine, the majority of the combustor outer casing portion will often have an alignment which is generally parallel to the principal and rotational axis 11 of the component 40 or the gas turbine engine 10, the downstream end surface of the combustor outer casing portion could be at any of a range of angles to the principal and rotational axis 11 of the component 40 or the gas turbine engine 10, whilst still facing in a generally downstream direction.

Figure 4:
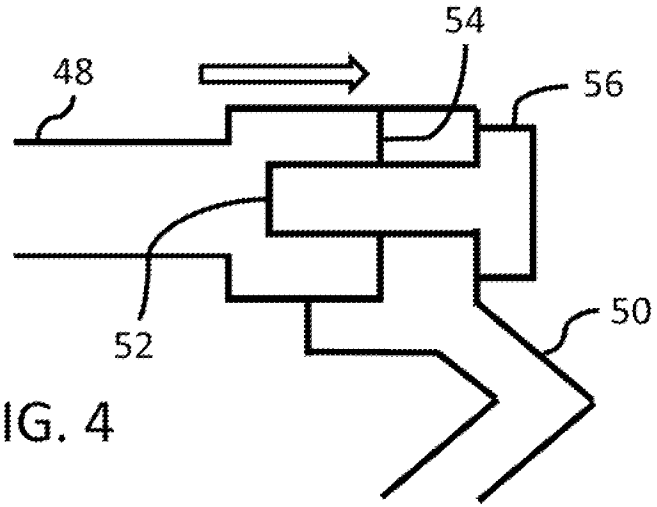
FIG. 4 is a sectional view of the boxed-out region labelled B in FIG. 3, showing where the combustor outer casing portion of the single-piece combustor casing component connects to a turbine nozzle guide vane support structure.

The example of FIG. 4 shows a sectional view of the downstream end of the combustor outer casing portion 48, which has a thickened region where the blind hole is situated. It will be understood the thickened region may extend completely around the circumference of the downstream end of the combustor outer casing portion, or be situated only in proximity of the blind holes 52 and associated connection points.

Figure 5:
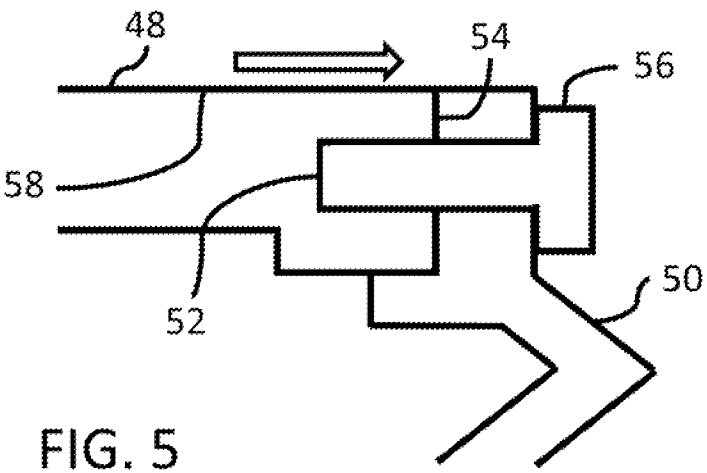
FIG. 5 is a sectional view of the boxed-out region labelled B in FIG. 3, showing an alternative design for the connection between the combustor outer casing portion and the turbine nozzle guide vane support structure.
Figure 8:
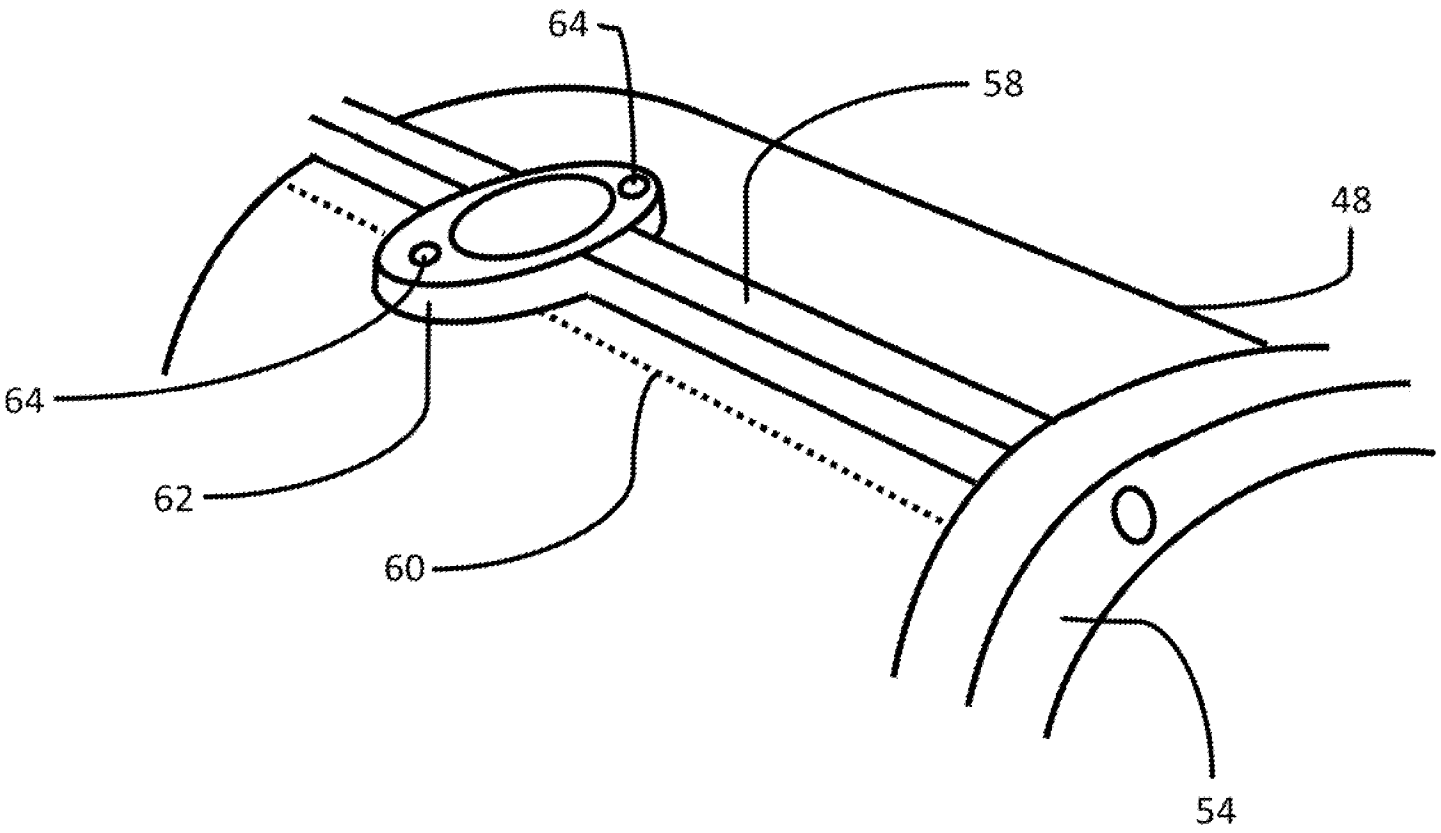
FIG. 8 is an isometric view of a section of the combustor outer casing portion of the single-piece combustor casing component of the present disclosure.

FIG. 5 shows an alternative embodiment of the downstream end of the combustor outer casing portion, where the combustor outer casing portion 48 comprises one or more external axial ribs 58 (see also FIG. 8). The external axial ribs act to increase the structural rigidity of the combustor outer casing portion. By circumferentially aligning the blind holes 52 with the external axial ribs on the external surface of the combustor outer casing portion, the need for specially introduced thickening of the downstream end of the combustor outer casing portion around the blind hole is reduced, and can instead be incorporated into or replaced by the external axial rib 58.

Figure 6:
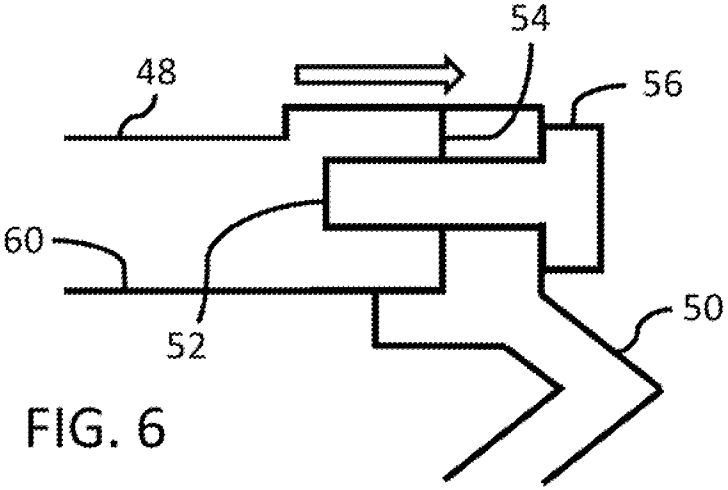
FIG. 6 is a sectional view of the boxed-out region labelled B in FIG. 3, showing a second alternative design for the connection between the combustor outer casing portion and the turbine nozzle guide vane support structure.

FIG. 6 shows another alternative embodiment of the downstream end of the combustor outer casing portion, where the combustor outer casing portion 48 comprises one or more internal axial ribs 60 (see also dotted line in FIG. 8).

In a similar fashion to that of the external axial rib, the internal axial ribs act to increase the structural rigidity of the combustor outer casing portion. As with the external axial rib, by circumferentially aligning the blind holes 52 with the internal axial ribs on the internal surface of the combustor outer casing portion, the need for specially introduced thickening of the downstream end of the combustor outer casing portion around the blind hole is reduced, and can instead be incorporated into or replaced by the internal axial rib 60.

Figure 7:
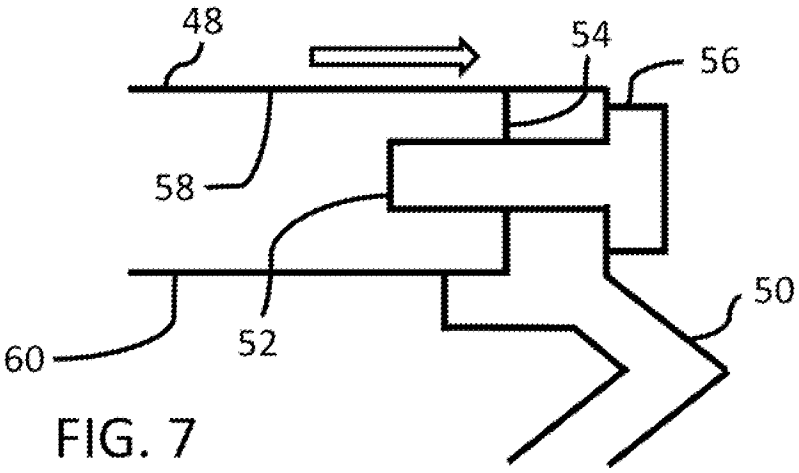
FIG. 7 is a sectional view of the boxed-out region labelled B in FIG. 3, showing a third alternative design for the connection between the combustor outer casing portion and the turbine nozzle guide vane support structure.

FIG. 7 shows a further alternative embodiment of the downstream end of the combustor outer casing portion, where the combustor outer casing portion 48 comprises one or more axial ribs 58,60 on both the internal and external surfaces (see also FIG. 8). In this example, the one or more external axial ribs 58 are radially aligned with the internal axial ribs 60, so as to form a section of the combustor outer casing portion which is thickened both internally and externally in an axially aligned direction, i.e. a direction whose major component runs parallel to the rotational axis of the combustor outer casing portion, and is generally aligned with the primary gas flow direction when in use. As with the examples of FIGS. 5 and 6, by circumferentially aligning the blind holes 52 with the axial ribs 58,60 on the internal and external surfaces of the combustor outer casing portion, the need for specially introduced thickening of the downstream end of the combustor outer casing portion around the blind hole is reduced, and can instead be incorporated into or replaced by the external and internal axial ribs 58,60.

FIG. 8 further illustrates a mounting flange 62 of the single-piece combustor casing component 40 in the combustor outer casing portion 48. The mounting flange 62 is configured to receive a mounting for a retractable fuel supply stem (not shown), which supplies fuel to the combustion equipment 16 contained within the component when installed within a gas turbine engine 10. In this example embodiment, the mounting flange 62 has two apertures 64 configured to receive attachment elements (such as bolts or screws) that can fix the mounting for the retractable fuel supply stem to the combustor outer casing portion 48. However, the mounting flange 62 can have further apertures configured to receive attachment elements incorporated into its design, should the specifics of the engine require, for example, further redundancy.

Figure 9:
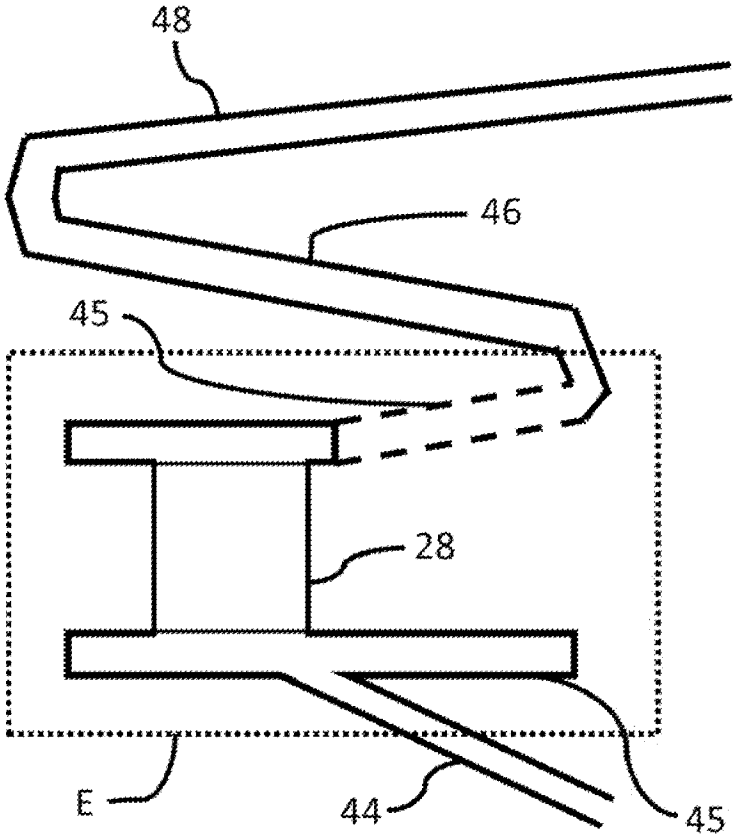
FIG. 9 is a sectional view of the boxed-out region labelled C in FIG. 3.

FIG. 9 shows the boxed-out region labelled C in FIG. 3. The region includes the outlet guide vane 28, the pre-diffuser portion 45, the outlet guide vane outer case portion 46, and a section of the combustor outer casing portion 48 of the component 40. The section of the component 40 radially outward from the outlet guide vane 28 has a particular design unique to the single-piece combustor casing component of the present disclosure. This region of the component 40 has an 'S'-shaped profile when viewed in section in the top half of the engine (with the 'S' shape being reversed in the bottom half due to rotational symmetry). More specifically, the pre-diffuser portion 45 extends downstream of, and radially outwards from, the outlet guide vane 28, before joining to the outlet guide vane outer case portion 46, which extends upstream of, and radially outwards from, the pre-diffuser portion. The outlet guide vane outer case portion 46 then joins to the combustor outer casing portion 48, which extends downstream of, and radially outwards from, the outlet guide vane outer case portion 46, so as to form as 'S'-shaped profile.

This configuration provides advantages. The 'S' shape acts as a spring section, providing a degree of flexibility to the component in a region where, in use, thermal gradients can lead to material expansion, which in turn can lead to stress fractures. The 'S' shape allows the component to flex as it grows hotter, reducing the risk of thermally-induced stress fractures, which improves the reliability and lifetime of the component.

When the single-piece combustor casing component is made using an ALM technique, the pre-diffuser portion 45 can contain one or more apertures. These apertures provide a path between a region of comparative high pressure (indicated by the label 'H' in FIG. 3) within the component 40 to a plenum region of comparative low pressure (indicated by the label 'L' in FIG. 3) outside of the component 40. In use, the delta plenum pressure between the two regions leads to gas flow from the high pressure region to the low pressure region through the apertures in the pre-diffuser. This in turn has the effect that the boundary layer downstream of the outlet guide vane is significantly reduced or even eliminated, which in turn allows for an aggressive separation of the high-pressure compressor exit, meaning the length of the combustor module can be reduced. As a result, the combustor module can fit into a smaller volume, and an engine comprising the component 40 can benefit from having a reduced mass.

Figure 10:
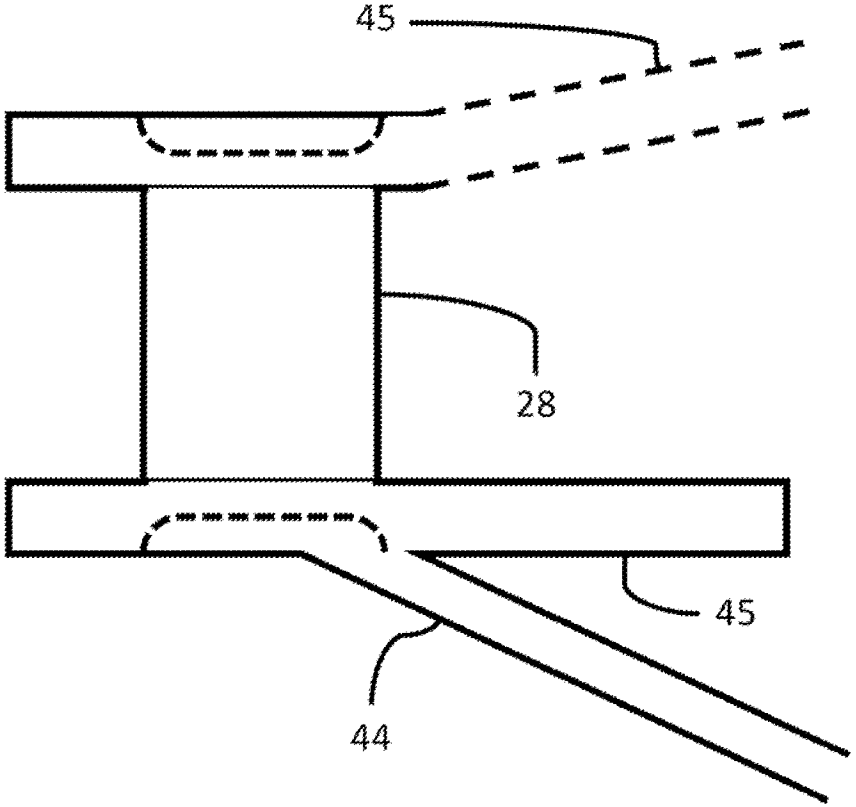
FIG. 10 is a sectional view of the boxed-out region labelled E in FIG. 9.
Figure 11:
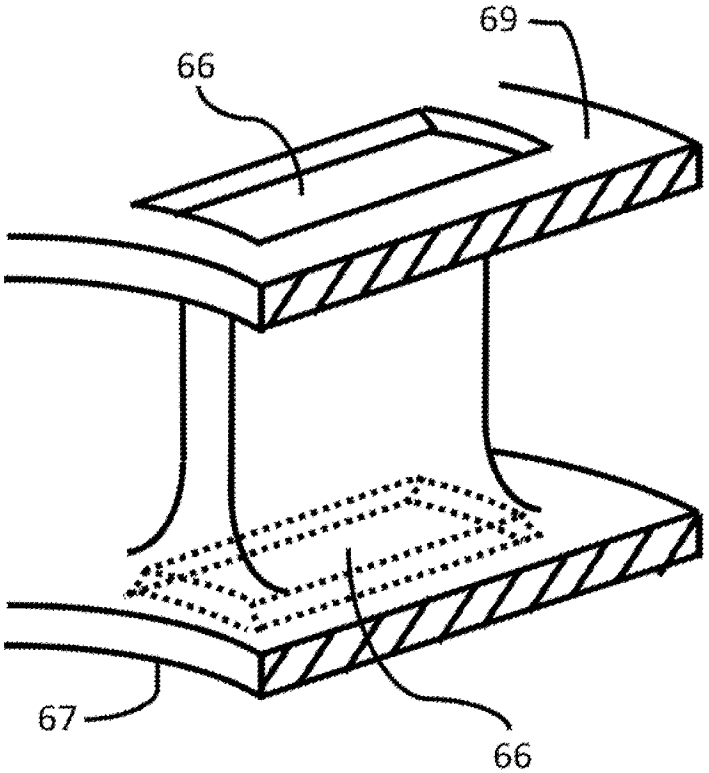
FIG. 11 is an isometric view of the region where the outlet guide vane meets the outlet guide vane inner case portion and outlet guide vane outer case portion.

FIG. 10 shows the boxed-out region labelled E in FIG. 9. This region contains the outlet guide vane 28 and parts of the outlet guide vane inner support 67 and outlet guide vane outer support 69. FIG. 10 illustrates further optional features of the component 40. In use, the component operates at a range of high temperatures, and so thermal management is an important consideration in the design of the component. As such, interfaces between thicker and thinner parts of the component can become areas of thermal stress. In order to prevent build-up of thermal stress, material can be removed from the interfaces between the outlet guide vane 28 and the outlet guide vane inner support 67. Such a removal of material can result in recessed regions on the surface of the outlet guide vane inner support 67 (see dotted lines on FIG. 11), such recessed regions otherwise being described as scalloped regions 66, or simply scallops. When the interface between the outlet guide vane 28 and outlet guide vane inner support 67 has been scalloped in this fashion, thermal stress at this location of the component 40 is reduced.

Similarly, material can be removed from the interfaces between the outlet guide vane 28 and the outlet guide vane outer support 69. Again, this removal of material can result in similarly recessed or scalloped regions on the surface of the outlet guide vane outer support 69 (see FIG. 11). When the interface between the outlet guide vane 28 and outlet guide vane outer support 69 has been scalloped in this fashion, thermal stress at this location of the component 40 is reduced. Material may be removed from just the outlet guide vane inner support 67, the outlet guide vane outer support 69, or both.

Figure 12:
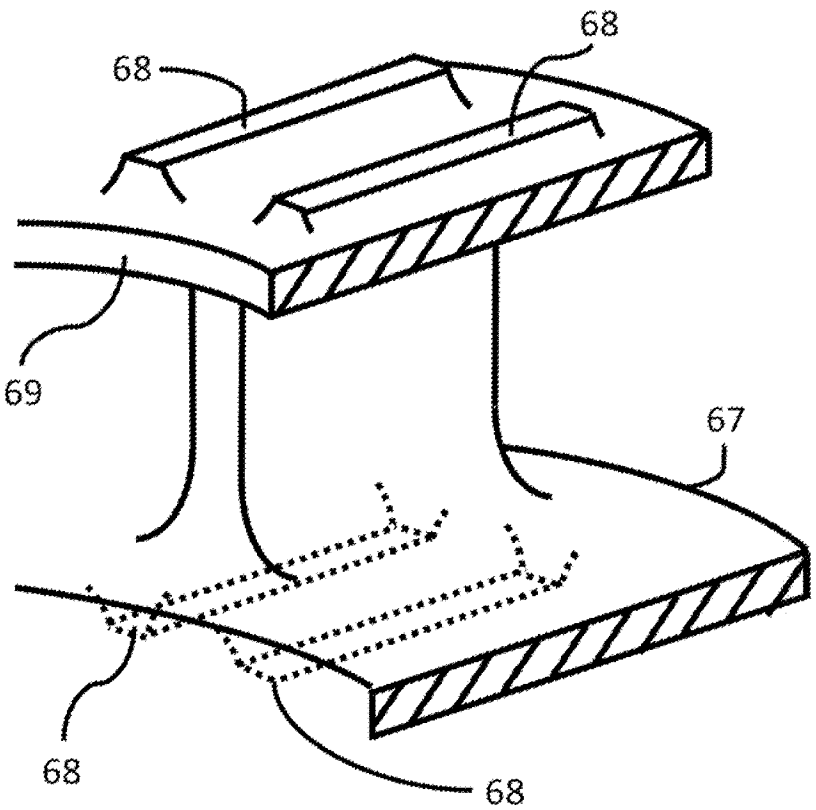
FIG. 12 is an isometric view of an alternative embodiment of the region where the outlet guide vane meets the outlet guide vane inner case portion and outlet guide vane outer case portion.

FIG. 12 also shows the boxed-out region labelled E in FIG. 9. In this alternative example embodiment, the parts of the component 40 adjacent to the outlet guide vane are labelled as the outlet guide vane inner support 67 and the outlet guide vane outer support 69. The outlet guide vane inner support and the outlet guide vane outer support are both shown having ridges 68. These ridges are aligned with the chord direction of the outlet guide vane. The ridges are sections of the outlet guide vane inner support and/or outlet guide vane outer support which are thicker than the surrounding section of the outlet guide vane inner support and/or outlet guide vane outer support, respectively. These ridges serve to increase the stiffness and structural integrity of the outlet guide vane inner case portion 44 and outer case portion 46 supports where they interface with the outlet guide vane 28, particularly in the direction of the chord of the outlet guide vane.

It will be understood that the ridges on the outlet guide vane inner support 67 (shown in dotted lines in FIG. 12) and the ridges on the outlet guide vane outer support 69 are not interrelated, and each can independently be included as part of the component as necessary. It will be further understood that the ridges are compatible with the scalloped regions, such that, when combined, the scalloped regions may fall between the ridges such that there are gradual transitions between the regions where the component material is thinner in the scallops, and the regions where the material is thicker in the ridges. The combination of these features provides the advantages of both respective features as described above.

Figure 14:
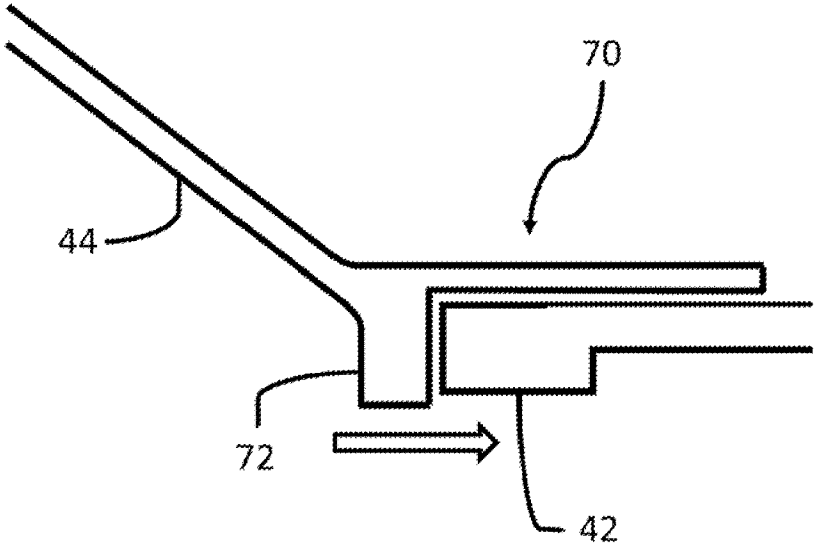
FIG. 14 is a sectional view of an alternative configuration of the boxed-out region labelled D in FIG. 3.
Figure 13:
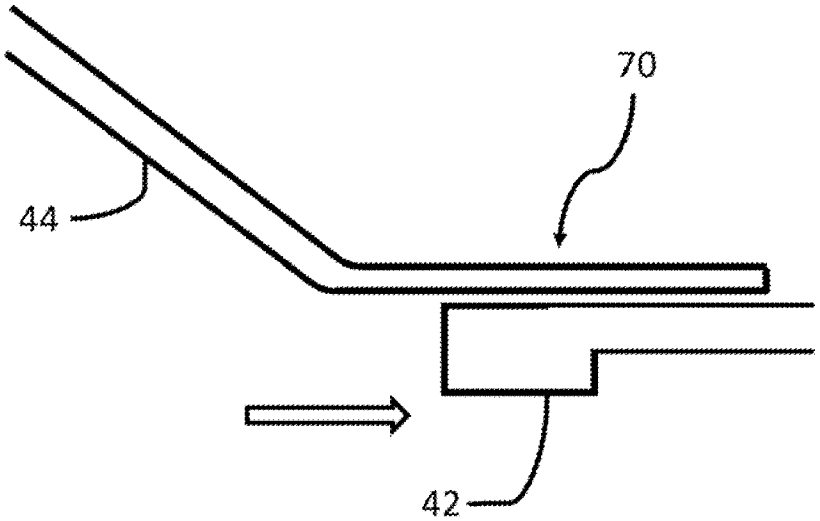
FIG. 13 is a sectional view of the boxed-out region labelled D in FIG. 3.

FIGS. 13 and 14 show alternative embodiments of the boxed-out region labelled D in FIG. 3. This is another region where, in the prior art systems, the components were typically bolted together via mating flanges. In this example of the present disclosure however, the flanges have been replaced by a low-profile sliding joint interface 70 with a clearance fit between the downstream end of the outlet guide vane inner case portion 44 and the combustor inner casing portion 42. Such a sliding joint interface reduces the mechanical load that would otherwise be transferred from the combustor inner casing portion, through the outlet guide vane inner case portion, to the comparatively fragile compressor outlet guide vanes.

To protect against pressure loads generated in a running engine, the sliding joint interface 70 may be augmented with a stiffening feature 72, such as a hoop of thickened material proximal to the sliding joint interface. Such a stiffening feature may also help reduce/prevent galling and/or fretting at the interface. As with the interface between the combustor outer casing portion 48 and the turbine nozzle guide vane support structure 50, by removing a radially protruding flange, and in this case replacing it with a sliding joint interface, the joint becomes more streamlined, and the aerodynamics of gas flow (indicated by the block arrow in FIGS. 13 and 14) in the region is improved, improving the efficiency of the engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A single-piece combustor casing component for a gas turbine engine, the single-piece combustor casing component comprising:

a combustor outer casing portion;

an outlet guide vane outer case portion;

a pre-diffuser portion;

a plurality of outlet guide vanes; and an outlet guide vane inner case portion, further comprising an end surface, the end surface including a plurality of blind holes for receiving connectors, wherein the combustor outer casing portion comprises one or more axial ribs, and at least one of the plurality of blind holes is radially aligned with an axial rib, wherein the one or more axial ribs are on at least one of an external surface or an internal surface of the combustor outer casing portion, wherein the combustor outer casing portion has one or more axial ribs on both the internal and external surfaces, and each axial rib on the external surface is radially aligned with a respective axial rib on the internal surface.

2. A single-piece combustor casing component for a gas turbine engine, the single-piece combustor casing component comprising:

a plurality of outlet guide vanes;

an outlet guide vane outer support coupled to a radially outward most end of the plurality of outlet guide vanes;

a pre-diffuser portion coupled to and extending axially aft from an aft end of the outlet guide vane outer support, the pre-diffuser portion defining a flow path outlet at a radially outward most end of the pre-diffuser portion, the radially outward most end of the pre-diffuser portion being aft of a forward most end of the pre-diffuser portion;

an outlet guide vane outer case portion coupled to and extending axially forward from the radially outward most end of the pre-diffuser portion;

a combustor outer casing portion, an axially forward most end of the combustor outer casing portion coupled to and extending axially aft from a radially outward most end of the outlet guide vane outer case portion, an axially aft most end of the combustor outer casing configured to connect to a turbine nozzle guide vane support structure; and an outlet guide vane inner case portion, wherein the combustor outer casing portion, the outlet guide vane outer case portion, and the pre-diffuser portion form an 'S'-shaped profile to act as a spring section and allow the single-piece combustor casing component to flex during thermal expansion.

3. The single-piece combustor casing component of claim 2, further comprising an end surface, the end surface including a plurality of blind holes for receiving connectors.

4. The single-piece combustor casing component of claim 3, wherein the combustor outer casing portion comprises one or more axial ribs, and at least one of the plurality of blind holes is radially aligned with an axial rib.

5. The single-piece combustor casing component of claim 4, wherein the one or more axial ribs are on at least one of an external surface or an internal surface of the combustor outer casing portion.

6. The single-piece combustor casing component of claim 2, further comprising a mounting flange for a retractable fuel stem.

7. The single-piece combustor casing component of claim 6, wherein the mounting flange is configured to receive two attachment bolts.

8. The single-piece combustor casing component of claim 1, wherein the pre-diffuser portion includes one or more apertures to allow gas to pass through the pre-diffuser portion from within the single-piece combustor casing component to outside of the single-piece combustor casing component.

9. The single-piece combustor casing component of claim 2, wherein the outlet guide vane outer support is formed of a material that is scalloped so as to reduce the difference in material thickness between the plurality of outlet guide vanes and the outlet guide vane outer support.

10. The single-piece combustor casing component of claim 2, wherein the plurality of outlet guide vanes are coupled to an outlet guide vane inner support, and the outlet guide vane inner support is formed of a material that is scalloped so as to reduce the difference in material thickness between the plurality of outlet guide vanes and the outlet guide vane inner support.

11. The single-piece combustor casing component of claim 2, wherein the outlet guide vane outer support comprises one or more ridges for increasing the stiffness of the outlet guide vane outer support.

12. The single-piece combustor casing component of claim 2, wherein an outlet guide vane inner support is coupled to the plurality of outlet guide vanes, the outlet guide vane inner support comprising one or more ridges for increasing the stiffness of the outlet guide vane inner support.

13. The single-piece combustor casing component of claim 2, wherein the outlet guide vane inner case portion further comprises a sliding joint for interfacing with a combustor inner casing.

14. The single-piece combustor casing component of claim 13, wherein the outlet guide vane inner case portion further comprises a hoop-stiffening feature that is located proximal to the sliding joint to reduce galling and fretting.

15. A gas turbine engine including the single-piece combustor casing component of claim 2.

16. The single-piece combustor casing component of claim 2, further comprising an end surface including a plurality of blind holes for receiving connectors, an external axial rib disposed on an external surface of the combustor outer casing portion, and an internal axial rib disposed on an internal surface of the combustor outer casing portion, the internal axial rib circumferentially aligned with the external axial rib, wherein at least one of the plurality of blind holes is circumferentially aligned with the external axial rib and the internal axial rib.

* * * * *